US010940875B2

(12) United States Patent
Brueggen et al.

(10) Patent No.: US 10,940,875 B2
(45) Date of Patent: Mar. 9, 2021

(54) VEHICLE, IN PARTICULAR RAIL VEHICLE

(71) Applicant: SIEMENS MOBILITY GMBH, Munich (DE)

(72) Inventors: Andreas Brueggen, Mettmann (DE); Michael Drews, Duesseldorf (DE); Thomas Reschat, Cologne (DE)

(73) Assignee: Siemens Mobility GmbH, Munich (DE)

( * ) Notice: Subject to any disclaimer, the term of this patent is extended or adjusted under 35 U.S.C. 154(b) by 204 days.

(21) Appl. No.: 16/068,771

(22) PCT Filed: Jan. 30, 2017

(86) PCT No.: PCT/EP2017/051878

§ 371 (c)(1),
(2) Date: Jul. 9, 2018

(87) PCT Pub. No.: WO2017/133993

PCT Pub. Date: Aug. 10, 2017

(65) Prior Publication Data

US 2019/0016351 A1 Jan. 17, 2019

(30) Foreign Application Priority Data

Feb. 1, 2016 (DE) ..... 10 2016 201 437.4

(51) Int. Cl.
*B61D 17/22* (2006.01)
*B61G 5/10* (2006.01)

(52) U.S. Cl.
CPC ..... *B61D 17/22* (2013.01); *B61G 5/10* (2013.01)

(58) Field of Classification Search
CPC ..... B61D 17/20; B61D 17/22; B60D 1/62; B61G 5/10
See application file for complete search history.

(56) References Cited

U.S. PATENT DOCUMENTS 6,076,470 A * 6/2000 Koch ..... B60D 5/006 105/14
6,940,019 B2 * 9/2005 Ikeda ..... H02G 11/006 174/68.3

(Continued)

FOREIGN PATENT DOCUMENTS

AU 2007201160 A1 10/2007
DE 19621913 C1 4/1997

(Continued)

OTHER PUBLICATIONS

WIKIPEDIA, the free encylopedia; "Cable Carrier"; https://web.archive.orgiweb/20130722082149/https://en.wikipedia.org/wiki/Cable_carrier; 2013.

*Primary Examiner* — Jason C Smith

(74) *Attorney, Agent, or Firm* — Laurence Greenberg; Werner Stemer; Ralph Locher

(57) ABSTRACT

A vehicle, particularly a rail vehicle, includes at least two coach bodies being coupled together and at least one line bridging a gap between the coach bodies. The line, which is an outwardly electrically insulated high-voltage line, is flexible and is guided by a cable guiding device in the region of the gap between the coach bodies at least in sections. The cable guiding device includes a multiplicity of guiding elements which are mechanically coupled together and can be pivoted in relation to each other in a guiding plane. The cable guiding device is flexible in the guiding plane and is less flexible in a plane which is perpendicular thereto than in the guiding plane.

15 Claims, 3 Drawing Sheets

(56) References Cited

U.S. PATENT DOCUMENTS

| | | | | |
|---|---|---|---|---|
| 8,366,132 | B2 * | 2/2013 | Browne | B61D 17/22 280/403 |
| 10,195,915 | B2 * | 2/2019 | Browne | B62D 47/025 |
| 2011/0247850 | A1 * | 10/2011 | Guyader | B61G 5/06 174/8 |
| 2011/0272915 | A1 * | 11/2011 | Browne | B60D 1/62 280/403 |
| 2019/0016351 | A1 * | 1/2019 | Brueggen | B61D 17/22 |

FOREIGN PATENT DOCUMENTS

| | | | |
|---|---|---|---|
| DE | 19614427 | A1 | 10/1997 |
| DE | 19714543 | C1 | 8/1998 |
| DE | 102004050969 | A1 | 6/2005 |
| DE | 102005016568 | A1 | 10/2006 |
| DE | 202006013969 | U1 | 11/2006 |
| DE | 102010011903 | A1 | 11/2011 |
| EP | 1043207 | A1 | 10/2000 |
| EP | 2233327 | A1 | 9/2010 |
| RU | 2430847 | C2 | 10/2011 |
| RU | 2563475 | C2 | 9/2015 |
| SU | 931550 | A1 | 5/1982 |
| WO | 9742045 | A1 | 11/1997 |
| WO | 0168433 | A1 | 9/2001 |

* cited by examiner

VEHICLE, IN PARTICULAR RAIL VEHICLE

BACKGROUND OF THE INVENTION

Field of the Invention

The invention relates to vehicles, in particular rail vehicles, having at least two coach bodies coupled together, wherein at least one line bridges a gap between the coach bodies.

Since a relative movement between the coach bodies cannot be avoided during the operation of the vehicle, it is advantageous to design the line between the coach bodies as flexible, or at least as slightly flexible.

SUMMARY OF THE INVENTION

The underlying object of the invention is to specify a vehicle in which—in respect of the line between the coach bodies—a reliable and low-wear operation of the vehicle can be achieved.

This object is achieved in accordance with the invention by a vehicle with the features of the independent claim. Advantageous embodiments of the inventive vehicle are specified in the dependent claims.

Accordingly there is provision in accordance with the invention for a line, specifically an outwardly insulated high-voltage electrical line, to be flexible and to be guided in the area of the gap between the coach bodies at least in sections by means of a cable guiding device, which is flexible in a guiding plane and, in a plane perpendicular thereto, is less flexible than it is in the guiding plane. The cable guiding device in this case has a plurality of guiding elements coupled mechanically to one another, which can be pivoted relative to one another in the guiding plane.

An important advantage of the inventive vehicle is to be seen as the inventive cable guiding device preventing a flexible line drooping down in a dangerous manner in the gap area between the coach bodies, by which the line becomes trapped between moving parts and damage can be avoided for example.

Preferably the cable guiding device is arranged in the area of the gap between the two coach bodies such that the guiding plane of the cable guiding device is arranged in parallel to the vehicle support plane on which the vehicle is standing or moves, in particular horizontal or at least in an angular range of ±10 degrees to the horizontal, when the vehicle is standing horizontally.

Neighboring guiding elements are preferably each connected by means of a pivot support, of the which the pivot axis is arranged perpendicular to the guiding plane and/or vertical, or at least in an angular range of between ±10 degrees to the vertical. The cable guiding device is preferably resistant to torsion in the plane perpendicular to the guiding plane. The mechanically coupled guiding elements preferably involve chain links. In this case, for the purposes of safe guidance, the line is routed through the chain links for example or at least held by said links.

The cable guiding device involves a cable carrier, also known as a drag chain, energy chain or cable chain.

The outwardly insulated high-voltage line carried by the cable guiding device is preferably designed so that it is suitable for carrying traction power with a rated voltage of 3 kV or 6 kV in the case of DC voltage and/or traction power with a rated voltage of 15 kV or 25 kV in the case of AC voltage.

In respect of the arrangement of the line and the cable guiding device it is seen as especially advantageous for a bellows device to be arranged between the coach bodies, which provides an external shield for a walk-through connection between the coach bodies, the bellows device having a radially outer bellows and a radially inner bellows and the cable guiding device being arranged between the inner and the outer bellows. This embodiment avoids the line and the cable guiding device increasing the air resistance and being subjected to external influences. For example the cable guiding device is arranged in a space in the roof area of the coach bodies, i.e. between the upper part of the inner and outer bellows in each case.

Preferably the bellows device has a support frame, on which the cable guiding device, in particular a central part section of the cable guiding device, is supported.

The support frame preferably has at least one sliding and/or rolling element, on which the cable guiding device, in particular a central part section of the cable guiding device, slides and/or rolls.

The bellows device preferably comprises a bellows section belonging to the one coach body and a bellows section belonging to the other coach body; the support frame is preferably arranged between the two bellows sections.

The vehicle can for example involve a railroad train with a plurality of individual coaches coupled to one another, or also an articulated train, in which the coach bodies form sections of the articulated train. The line preferably connects all coupled individual coaches or all sections of the articulated train to one another.

BRIEF DESCRIPTION OF THE SEVERAL VIEWS OF THE DRAWING

The invention will be explained in greater detail below with reference to exemplary embodiments; in the figures, by way of example

DESCRIPTION OF THE INVENTION

Figures 1, 2:
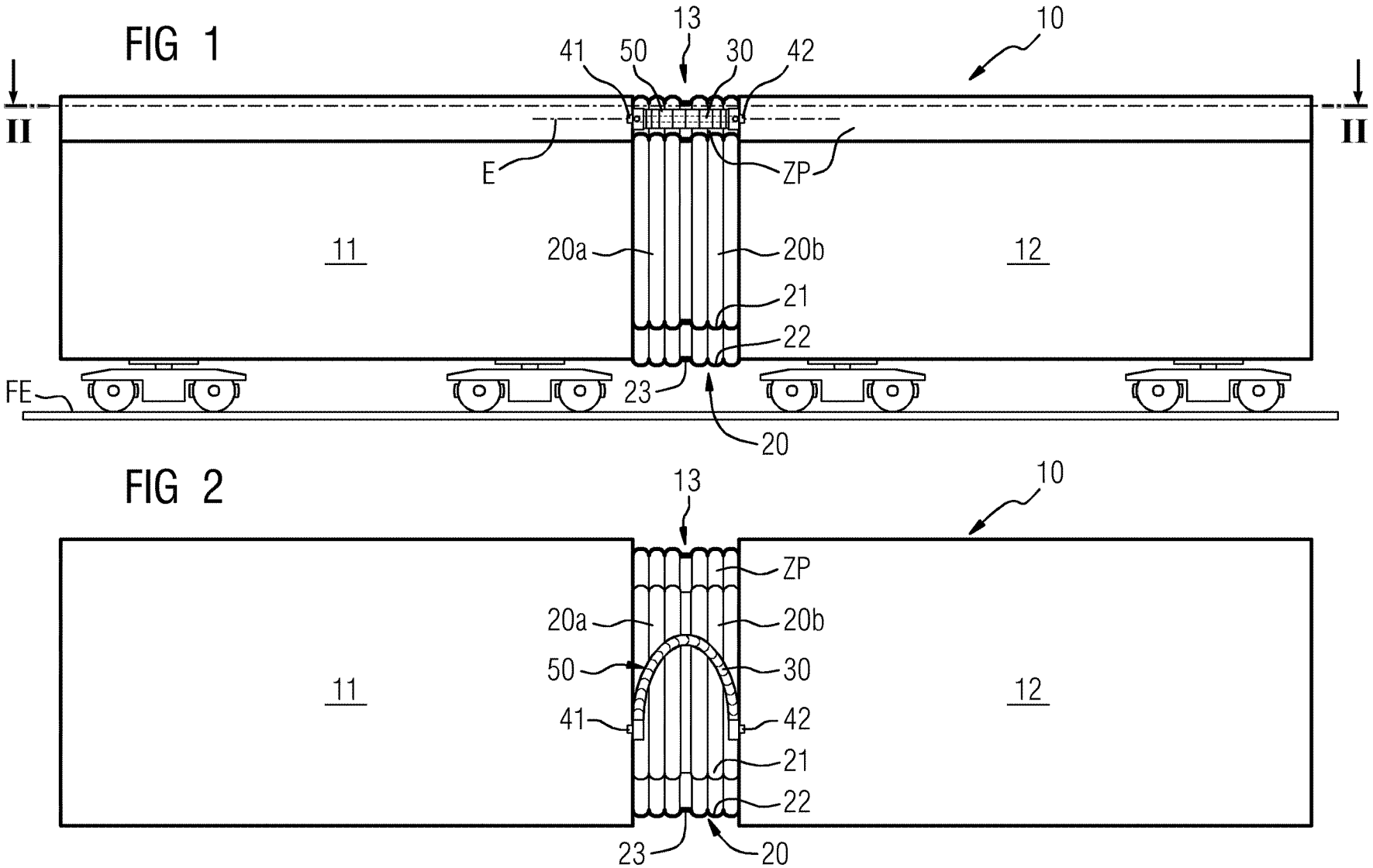
FIG. 1 shows an exemplary embodiment for an inventive rail vehicle, in which a line is guided in sections in a cable guiding device.
FIG. 2 shows a cross-section from above through the rail vehicle depicted in FIG. 1.

In the figures, for the sake of clarity, the same reference characters are used for identical or comparable components.

FIG. 1 shows an exemplary embodiment for an inventive rail vehicle 10, comprising two or more coach bodies coupled to one another. The coach bodies can form sections of an articulated train or can belong to individual coaches coupled to one another, as is shown by way of example in FIG. 1. In FIG. 1 two of the coach bodies of the train vehicle 10 are shown in greater detail and are identified in said figure by the reference numbers 11 and 12.

In order to make it possible for people to pass from coach 11 into coach 12 and vice versa, a gap 13 between the two coaches 11 and 12 is bridged by a traversable connecting device, which is not shown in any greater detail in FIG. 1, because it is shielded from the outside by a bellows device 20 arranged in the area of the gap 13. The traversable connecting device between the two coach bodies 11 and 12 can be formed by a gangway or the like for example.

In order to make it possible to divide up the rail vehicle 10 or to separate the coach bodies 11 and 12 from one another, the bellows device 20 preferably has a bellows section 20*a*, which belongs to the coach body 11 and also a bellows section 20*b*, which belongs to the coach body 12. A support frame 23 can be provided between the two bellows sections 20*a* and 20*b*.

The bellows device 20—and thus each of the two bellows sections 20*a* and 20*b*—has an inner bellows 21, which is enclosed to its outside by a bellows 22 lying radially outwards. Since the outer bellows 22 is larger than the inner bellows 21, a space is formed between the inner bellows 21 and the outer bellows 22, which is identified in FIG. 1 by the reference character ZP.

To connect the two coach bodies 11 and 12 a line 30 is provided, which is connected at one end of the line to a connecting element 41 of the coach body 11 and at another end of the line to a connecting element 42 of the coach body 11. The line 30 can in principle involve an electrical, optical, pneumatic or hydraulic line. It is advantageous for the line 30 to involve an energy transmission line in the form of an electrical, outwardly-insulated high-voltage line, which is suitable for carrying traction power for the rail vehicle 10. The line 30 is preferably designed so that it is suitable for a voltage range of 3 kV and/or 6 kV in the case of DC voltage or of 15 kV and/or 25 kV in the case of AC voltage or strong enough for these voltages.

In the case of an electrical line 30 the connecting elements 41 and 42 preferably involve electrical contact elements, e.g. in the form of electrical connection sockets or electrical connection plugs.

The line 30 is preferably arranged in the space ZP between the outer bellows 22 and the inner bellows 21; such an arrangement has the advantage that the line 30 does not cause any additional air resistance and is also protected from external influences.

Since, when the rail vehicle 10 is operating, certain relative movements between the coach bodies 11 and 12 can occur, the line 30 is preferably designed to be flexible. In order to prevent the line 30 drooping vertically downwards and also to prevent the undesired resting of the line 30 against the inner bellows 21 of the bellows device 20, the line 30 is guided in the exemplary embodiment depicted in FIG. 1 in the area between the coach bodies 11 and 12 at least in sections with a cable guiding device 50.

The cable guiding device 50 is flexible in a predetermined guiding plane and is less flexible in a plane perpendicular thereto than it is in the guiding plane, preferably torsionally stiff or at least almost torsionally stiff. The guiding plane of the cable guiding device 50 is identified in FIG. 1 with the reference character E.

It can be seen in FIG. 1 that the cable guiding device 50 is arranged so that its guiding plane E is parallel or at least approximately parallel (±10 degrees) to the plane of travel FE. The plane of travel FE is formed for the rail vehicle 10 depicted in FIG. 1 by the upper edge of the rail or by the plane of the rail on which the rail vehicle 10 is travelling. In other words the guiding plane E is thus arranged horizontal or at least approximately horizontal or in an angular range of ±10 degrees to the horizontal, when the rail vehicle is standing horizontally.

The cable guiding device 30 makes a relative movement between the two coach bodies 11 and 12 possible within the guiding plane E and, in doing so, simultaneously guarantees that the line 30 does not droop or at least does not droop substantially and preferably can have no contact with the inner bellows 21.

FIG. 2 shows the two coach bodies 11 and 12 in a view from above, and does so in a cross-sectional plane, which is identified in FIG. 1 by the reference characters II-II. The cross-sectional plane II-II lies within the space ZF or spatially between the inner bellows 21 and the outer bellows 22 of the bellows device 20 depicted in FIG. 1.

It can be seen that the line 30 with the two connection elements 41 and 42 is connected to the two coach bodies 11 and 12 and is curved in shape. The curvature and also the flexibility of the line 30 make it possible for the coach bodies 11 and 12 to move towards each other and away from each other (see also direction of arrow X in FIG. 3), without imposing any significant mechanical strain on the connection between the line 30 and the two connection elements 41 and 42. A relative movement between the coach bodies 11 and 12 will occur for example when the rail vehicle 10 travels through curves.

Figure 3:
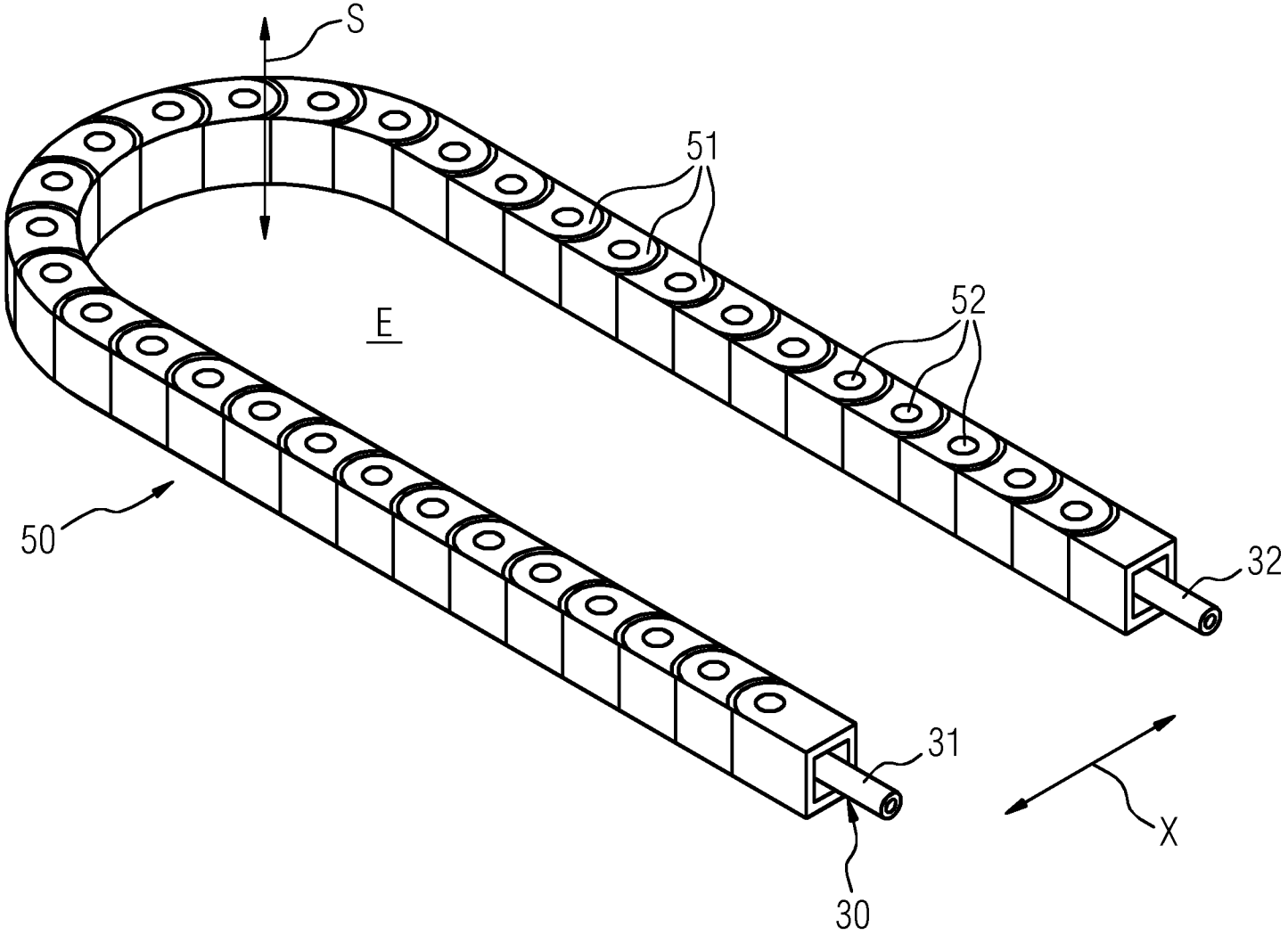
FIG. 3 shows an exemplary embodiment for a cable guiding device, which is used in the rail vehicle depicted in FIGS. 1 and 2.

FIG. 3 shows the line 30 depicted in FIGS. 1 and 2 as well as the cable guiding device 50 in greater detail in a three-dimensional diagram. The two ends of the line 31 and 32 can be seen, which are connected to the assigned connection elements 41 and 42 depicted in FIGS. 1 and 2.

The cable guiding device 50 preferably involves a cable carrier, also known in technical parlance as a drag chain, energy chain or cable chain. The cable guiding device 50 has a plurality of guiding elements coupled mechanically to one another in the form of chain links 51, which are able to be pivoted relative to one another in the guiding plane E.

In order to make it possible for the chain links 51 to be pivoted in the way described, neighboring chain links 51 are preferably each connected by a pivot support 52, of which the pivot axis S is arranged perpendicular to the guiding plane E. In the case of a horizontal arrangement of the cable guiding device 50, as is the case for example in FIGS. 1 and 2, the alignment of the pivot axis S of the pivot supports 52 is thus vertical or at least approximately vertical (±10 degrees to the vertical).

Since the cable guiding device 50 as depicted in FIG. 3 is formed by the chain links 51 connected pivotably to one another, the cable guiding device 50 is torsionally stiff or at least approximately torsionally stiff in the plane perpendicular to the guiding plane E. A mobility within the plane E and also bending of the line 30 in the area between the line ends 31 and 32 in the longitudinal direction of the vehicle X is guaranteed however.

To make it possible for the line 30 to be guided safely or reliably through or within the cable guiding device 50, it is seen as advantageous for the line 30 to be routed through the chain links 51. As an alternative there can be provision for the line 30 merely to have external support elements, which serve to hold the line 30 and prevent the line 30 from being able to droop vertically and in the direction of the inner bellows 21 as depicted in FIG. 1.

A further exemplary embodiment for a rail vehicle 10 is explained below in conjunction with FIGS. 4 and 5, in which a cable guiding device 50 is intended for guiding a line 50.

Figure 4:
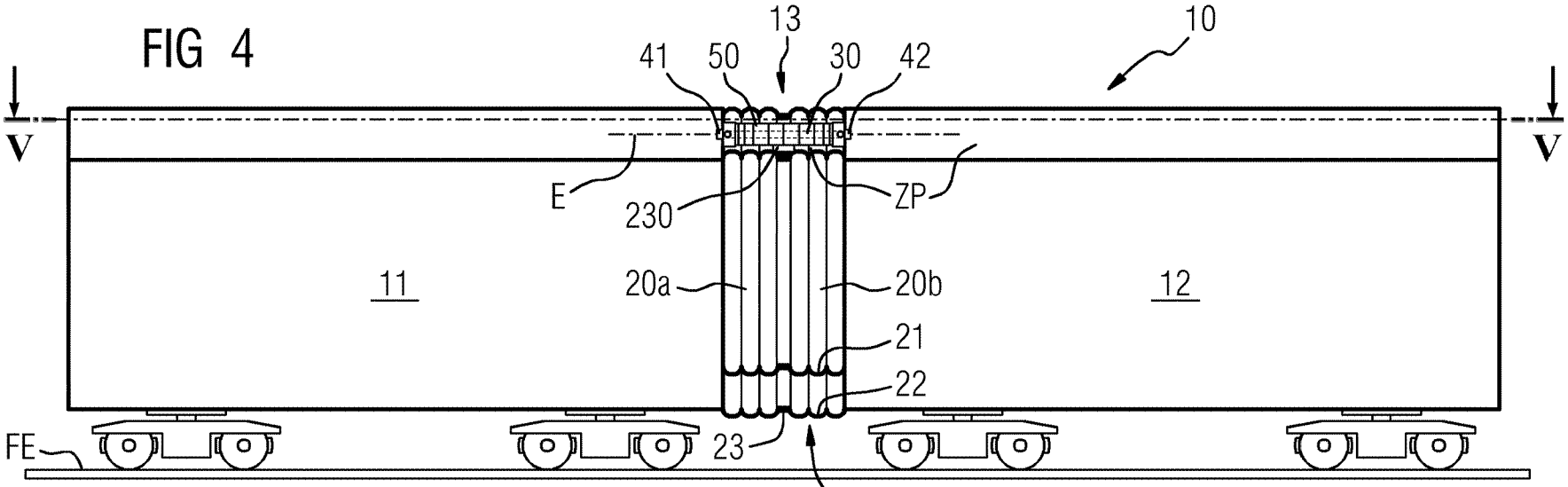
FIG. 4 shows a further exemplary embodiment for an inventive rail vehicle, in which a line is guided in sections in a cable guiding device, wherein the cable guiding device is supported on a support frame.
Figure 5:
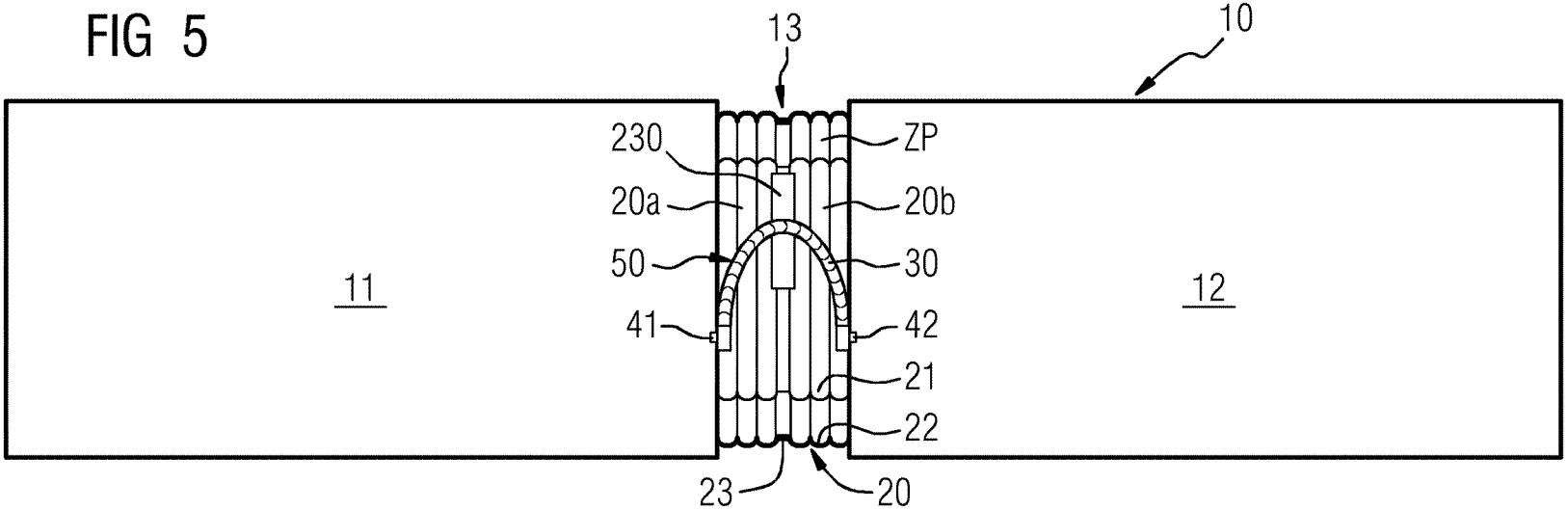
FIG. 5 shows a cross-section from above through the rail vehicle depicted in FIG. 4.

In the exemplary embodiment depicted in FIGS. 4 and 5 there is provision for the cable guiding device 50, in particular a central section of the cable guiding device 50, to be supported on a section of the support frame 23 of the bellows device 20. Such supporting of the cable guiding device 50 on the support frame insures that the cable guiding device 50 is highly unlikely to be able to come into contact with the inner bellows 21.

In respect of a low-friction contact between the cable guiding device 50 and the support frame 23, the latter is preferably equipped with a sliding and/or rolling element 230, on which the cable guiding device 50, in particular the central part section of the cable guiding device 50, can slide and/or roll with low friction. The sliding and/or rolling element 230 can for example involve a sliding plate, a sliding profile or also a support roller, on which the cable guiding device 50 rests.

FIG. 5 once again shows the bellows device 20 and also the sliding and/or rolling element 230 of the support frame 23 in greater detail in an overhead view in the plane V-V as depicted in FIG. 4. It can be seen that the cable guiding device 50 is supported in a sliding and/or rolling manner by the sliding and/or rolling element 230 and that drooping of the cable guiding device vertically or in the direction of the inner bellows 21 is avoided by the sliding and/or rolling element 230.

As an alternative there can be provision for the cable guiding device 50 to rest directly on the support frame 23, if said frame is not equipped with a sliding and/or rolling element 230. In such a case a degree of friction between the cable guiding device 50 and the support frame 23, depending on the choice of material, cannot be avoided, so that in such a form of embodiment the wear can be slightly greater.

Although the invention has been illustrated and described in greater detail by preferred exemplary embodiments, the invention is not restricted by the disclosed examples and other variations can be derived herefrom by the person skilled in the art, without departing from the scope of protection of the invention.

The invention claimed is:

1. A vehicle or rail vehicle, comprising:

at least two coach bodies being coupled together;

at least one flexible line bridging a gap between said coach bodies, said line being an outwardly electrically insulated high-voltage line; and a cable guiding device guiding at least sections of said line in a region of said gap between said coach bodies;

said cable guiding device having a multiplicity of guiding elements being mechanically coupled together, said guiding elements being pivotable relative to one another in a guiding plane and said guiding elements including neighboring guiding elements;

respective pivot supports interconnecting said neighboring guiding elements, said pivot supports having pivot axes disposed at least one of perpendicular to said guiding plane or vertically or at least in an angular range between ±10 degrees to the vertical; and said cable guiding device being flexible in said guiding plane and being less flexible in a plane perpendicular to said guiding plane than in said guiding plane.

2. The vehicle according to claim 1, wherein said cable guiding device is disposed in a region of said gap between said two coach bodies causing said guiding plane of said cable guiding device to be disposed parallel to a vehicle support plane in which the vehicle is standing or moving.

3. The vehicle according to claim 1, wherein said guiding plane of said cable guiding device is horizontal or is at least in an angular range between ±10 degrees to the horizontal.

4. The vehicle according to claim 1, wherein said cable guiding device is torsionally stiff in said plane perpendicular to said guiding plane.

5. The vehicle according to claim 1, wherein said mechanically coupled guiding elements are chain links.

6. The vehicle according to claim 5, wherein said line is routed through said chain links or is at least held by said chain links.

7. The vehicle according to claim 1, wherein said line is suitable for carrying at least one of traction power with a rated voltage of 3 kV or 6 kV in the case of DC voltage or traction power with a rated voltage of 15 kV or 25 kV in the case of AC voltage.

8. The vehicle according to claim 1, which further comprises:

a bellows device disposed between said coach bodies;

said bellows device providing an outer shield for a walk-through connection between said coach bodies;

said bellows device having a radially outer bellows and a radially inner bellows; and said cable guiding device being disposed between said inner and said outer bellows.

9. The vehicle according to claim 8, wherein said cable guiding device is disposed in a roof area of said coach bodies.

10. The vehicle according to claim 8, wherein said bellows device has a support frame and said cable guiding device is supported on said support frame.

11. The vehicle according to claim 10, wherein said cable guiding device has a center section supported on said support frame.

12. The vehicle according to claim 10, wherein said support frame has at least one of a sliding or rolling element on which said cable guiding device at least one of slides or rolls with low friction.

13. The vehicle according to claim 11, wherein said support frame has at least one of a sliding or rolling element on said center section of said cable guiding device at least one of slides or rolls with low friction.

14. The vehicle according to claim 10, wherein:

said bellows device has a bellows section belonging to one coach body and another bellows section belonging to another coach body; and said support frame is disposed between said bellows sections.

15. The vehicle according to claim 1, wherein:

the vehicle is a railroad train with a plurality of individual coaches coupled to one another or an articulated train in which said coach bodies form sections of the articulated train; and said line individually connects all coaches or sections to one another.

* * * * *